US010239596B2

(12) United States Patent
Owen, III

(10) Patent No.: US 10,239,596 B2
(45) Date of Patent: Mar. 26, 2019

(54) LATERAL THRUST DEVICE

(71) Applicant: Miller W. Owen, III, Panama City, FL (US)

(72) Inventor: Miller W. Owen, III, Panama City, FL (US)

( * ) Notice: Subject to any disclaimer, the term of this patent is extended or adjusted under 35 U.S.C. 154(b) by 0 days.

(21) Appl. No.: 15/673,747

(22) Filed: Aug. 10, 2017

(65) Prior Publication Data

US 2019/0047672 A1 Feb. 14, 2019

(51) Int. Cl.

| | |
|---|---|
| ***B63H 11/11*** | (2006.01) |
| *B63H 25/46* | (2006.01) |
| *B63H 11/113* | (2006.01) |

(52) U.S. Cl.

CPC ..... *B63H 11/11* (2013.01); *B63H 11/113* (2013.01); *B63H 25/46* (2013.01)

(58) Field of Classification Search

CPC ..... B63H 11/00; B63H 11/11; B63H 11/113

USPC ..... 440/38, 41, 42

See application file for complete search history.

(56) References Cited

U.S. PATENT DOCUMENTS

| | | | |
|---|---|---|---|
| 4,223,630 | A | 9/1980 | Kenney et al. |
| 5,752,864 | A | 5/1998 | Jones et al. |
| 6,227,919 | B1 | 5/2001 | Blanchard |
| 6,428,370 | B1 | 8/2002 | Jones |
| 6,652,332 | B1 | 11/2003 | Westhoff |
| 7,819,711 | B1 | 10/2010 | von Wolske |
| 2004/0253885 | A1 | 12/2004 | Westhoff et al. |
| 2005/0064771 | A1 | 3/2005 | Roos |

*Primary Examiner* — Lars A Olson

(74) *Attorney, Agent, or Firm* — Adrienne Love

(57) ABSTRACT

A device for redirecting a portion of the reverse flow of a jet stream created by a watercraft to provide a lateral thrust. The main body of device is fixed to the watercraft and includes a channel disposed therein. The channel has a curve that is defined by an outer wall. The channel fluidly connects an inlet to an outlet. The reverse flow enters inlet in a downward and backward direction with respect to main body. The inlet and the channel of main body bend the reverse flow such that when the reverse flow exits the outlet the reverse flow is primarily lateral.

16 Claims, 18 Drawing Sheets

LATERAL THRUST DEVICE

BACKGROUND OF THE INVENTION

1. Field of the Invention

This invention relates to the field of devices made for propelling watercraft. More specifically, the invention relates to a mechanism for redirecting a portion of the reverse flow of a jet stream created by a watercraft.

2. Description of the Related Art

A water-jet driven craft's primary means of steering is achieved by directing the flow of water through the thrust of the water jet propulsion system. Water jet propulsion vessels are popular for recreational watercrafts. A prior art watercraft 30 is illustrated in FIG. 1. These crafts are typically propelled by two or four stroke gasoline engines in connection with an impeller housed in a tubular chamber, the forward end of which draws in the water and the rearward end which expels it to provide thrust via the jet stream 40 in order to propel the craft or vessel. In most instances, a tubular nozzle (deflector nozzle 34) is attached to the discharge end (nozzle 35) which pivots from side to side in sync with the steering control 36 to provide steering capability.

A detailed view of a prior art jet propulsion system is shown in FIG. 2. The pump assembly 28 includes the tubular chamber (impeller housing 27) and the impeller duct 26, which draws in the water. The watercraft moves forward by expelling water out of first nozzle outlet 38 of deflector nozzle 34. The deflector nozzle 34 pivots in sync with the steering control 36 allowing the forward steering of the watercraft. As shown in FIG. 3, a reverse gate 32 is pivotably attached to deflector nozzle 34. Deflector nozzle 34 has a first nozzle outlet 38 and a second nozzle outlet 42. When reverse gate 32 is in an open position (as shown in FIGS. 2 and 3) jet stream expels water out of first nozzle outlet 38. When reverse gate 32 is a closed position (as shown in FIG. 5) jet stream is redirected out of second nozzle outlet 42 (reverse flow 41). As shown in FIG. 5, in a closed position reverse gate 32 diverts jet stream downward and slightly towards the back of the boat to allow the boat to slow, stop and/or drive the boat in reverse.

Currently, a watercraft has a limited turning radius when driven in reverse. When the deflector nozzle 34 is pivoted as far to the port side of the vessel as possible, the diverted jet stream is providing approximately 30 degrees of off plane steering to the vessel (as shown in FIG. 17A. The same is true in the opposite direction. Therefore, they are difficult to maneuver in small areas or around obstacles. Additionally, when a watercraft is moving in one direction, it is difficult to efficiently turn in the opposite direction. The bow of the watercraft tends to maintain the drift of the watercraft in the direction in which it is already moving. Therefore, in order to turn the watercraft the force acting on the bow must be overpowered.

Prior art steering systems attempted to solve this problem by developing reverse gates that are able to drastically redirect the jet flow. The directional reverse gates are horizontally fixed (independent of the steerable nozzle) and only pivot in the vertical plane. When the reverse gate is closed, covering the steerable nozzle, the water is drastically redirected in the direction that the steerable nozzle faces.

The prior art systems are not entirely effective. The drastic redirection of the entire water flow causes the boat to lurch to one side or the other. The force of the lateral thrust on the craft can be abrupt and forceful because the entirety of the flow is being redirected to one side or the other. Additionally, because the water flow is forced to the side of the boat that the deflector nozzles faces, the stern travels in the opposite direction of the steering (when in reverse). Thus, the steering is counter-intuitive.

What is needed is a device which can increase control of the vessel when traveling in reverse, without sacrificing the ease of use which deflector nozzle's reverse configuration provides. The present invention achieves this objective by providing sufficient lateral thrust to steer the craft in a controlled manner, and intuitively do so, much like automobiles and outboard powered craft. It is important to note that most boat operators will have years of automobile driving experience when they first operate a boat. Boat operators will find driving in reverse natural and intuitive with the present invention installed on the craft.

BRIEF SUMMARY OF THE INVENTION

A device for redirecting a portion of the reverse flow of a jet stream created by a watercraft to provide a lateral thrust. The main body of device is fixed to the watercraft and includes a channel disposed therein. The channel has a curve that is defined by an outer wall. The channel fluidly connects an inlet to an outlet. The reverse flow enters inlet in a downward and backward direction with respect to main body. The inlet and the channel of main body bend the reverse flow such that when the reverse flow exits the outlet the reverse flow is primarily lateral.

The main body of the device is fixed to the watercraft such that the inlet is beneath the deflector nozzle and is configured to accept a portion of the reverse flow as the deflector nozzle pivots to one side of the watercraft. A mirror image of the mam body is fixed to the watercraft proximate the second deflector nozzle and provides lateral thrust when turning in the opposite direction in the same manner as the device affixed to the first deflector nozzle. As the deflector nozzle pivots in one specific direction the area of the inlet exposed to the reverse flow increases slowly until the deflector nozzle has reached its maximum turn radius. Now the full area of inlet is available to redirect reverse flow.

The reverse flow is typically 30 degrees from the center plane of the watercraft. Therefore, redirection of the reverse flow provides greater angular deflection for a portion of the flow. As the user steers in reverse, the device provides lateral thrust and greater control over steering.

REFERENCE NUMERALS IN THE DRAWINGS

Figure 1:
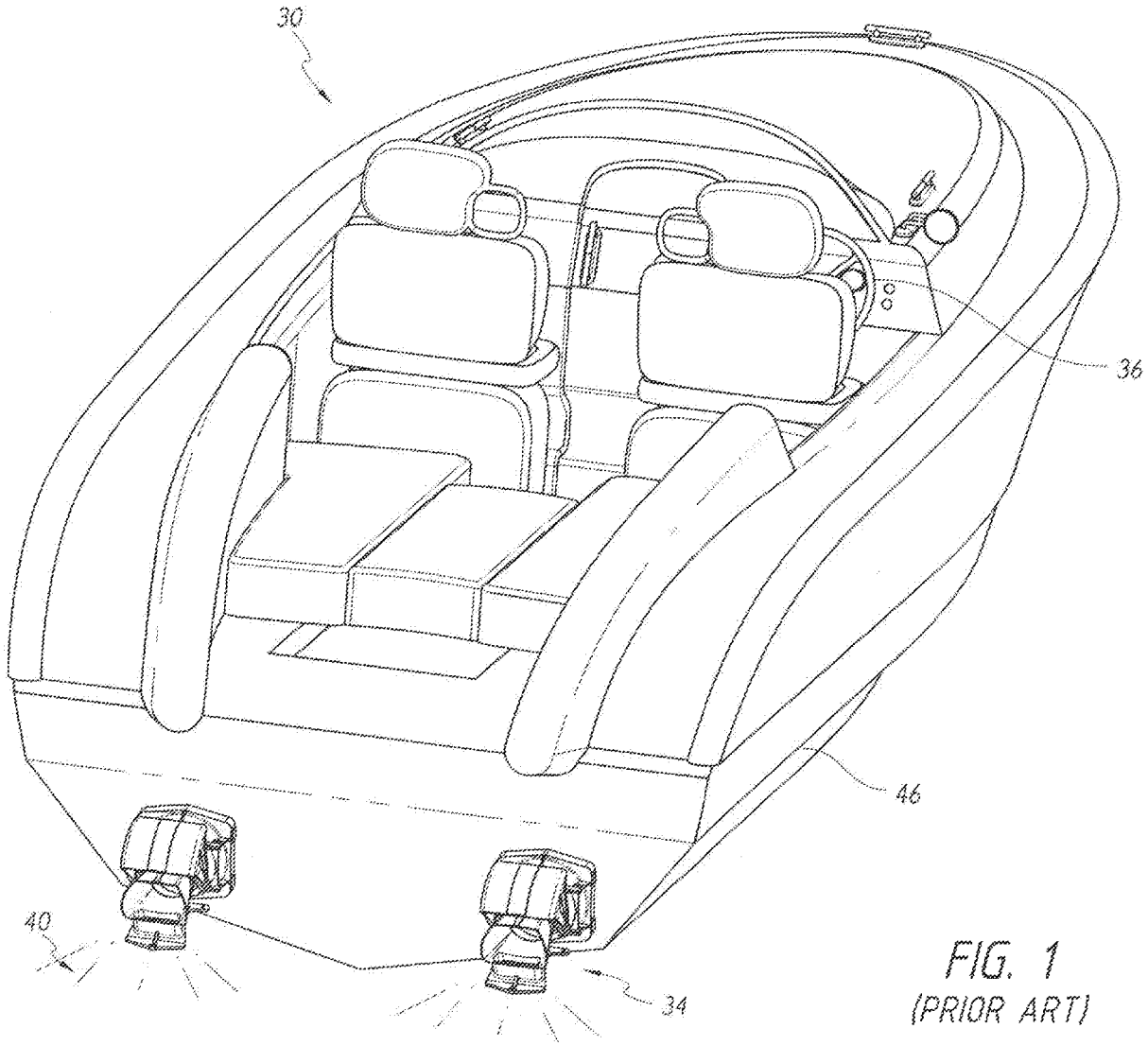
FIG. 1 (PRIOR ART)
FIG. 1 is a perspective view, showing a prior art watercraft.
Figure 2:
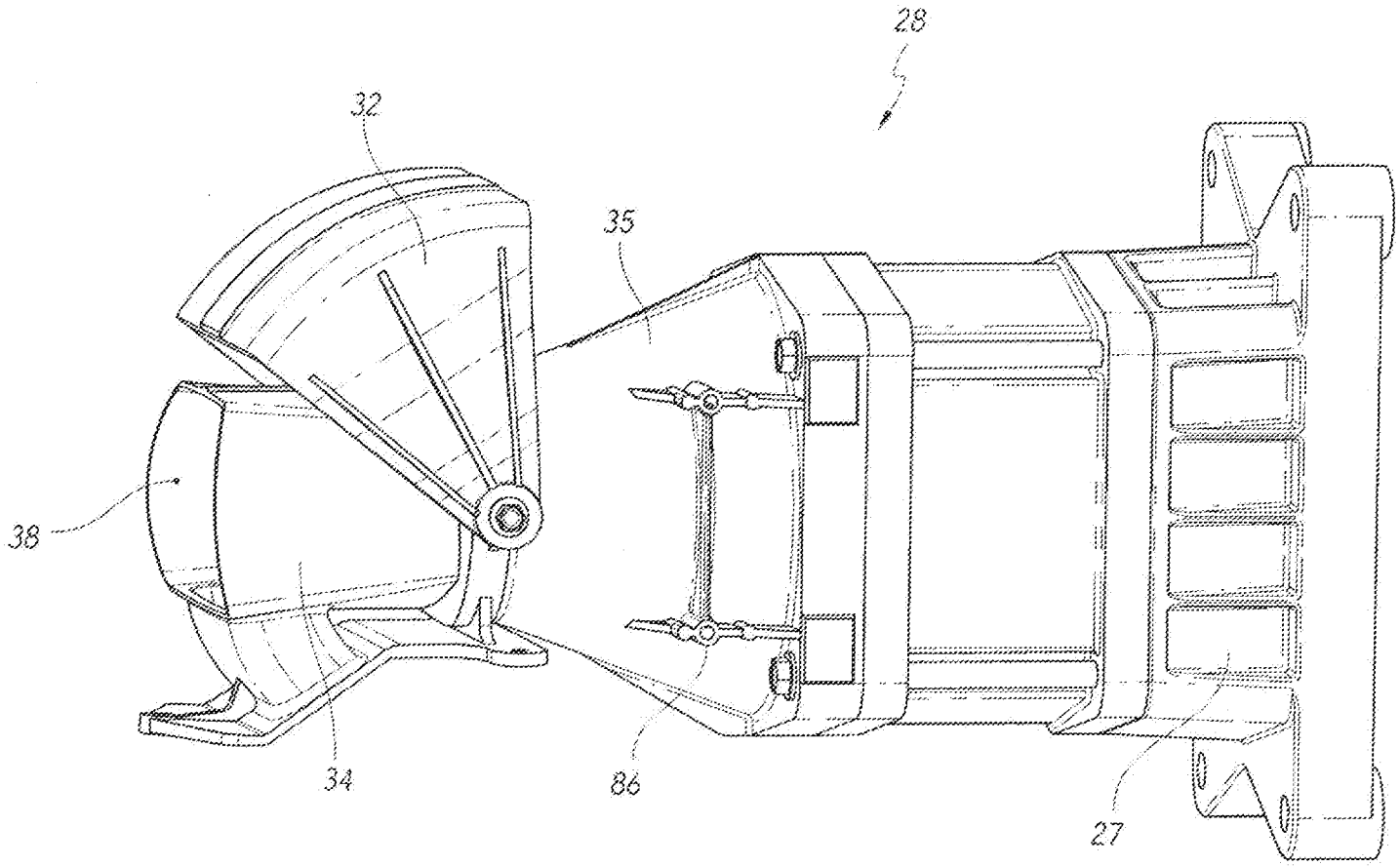
FIG. 2 (PRIOR ART)
FIG. 2 is a perspective view, showing a prior art jet propulsion system.
Figure 3:
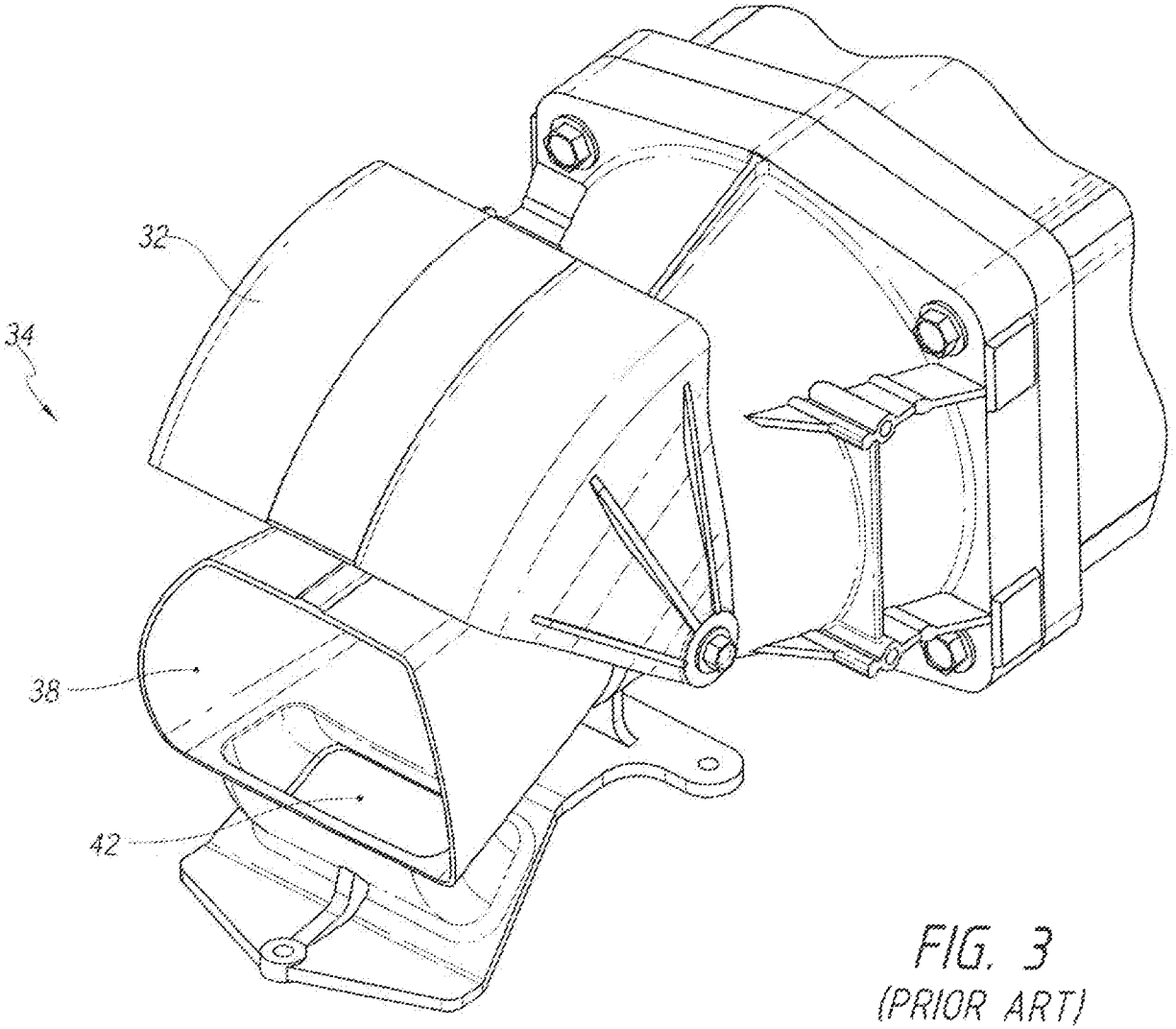
FIG. 3 (PRIOR ART)
FIG. 3 is a perspective view, showing a prior art deflector nozzle having a reverse gate.
Figure 4:
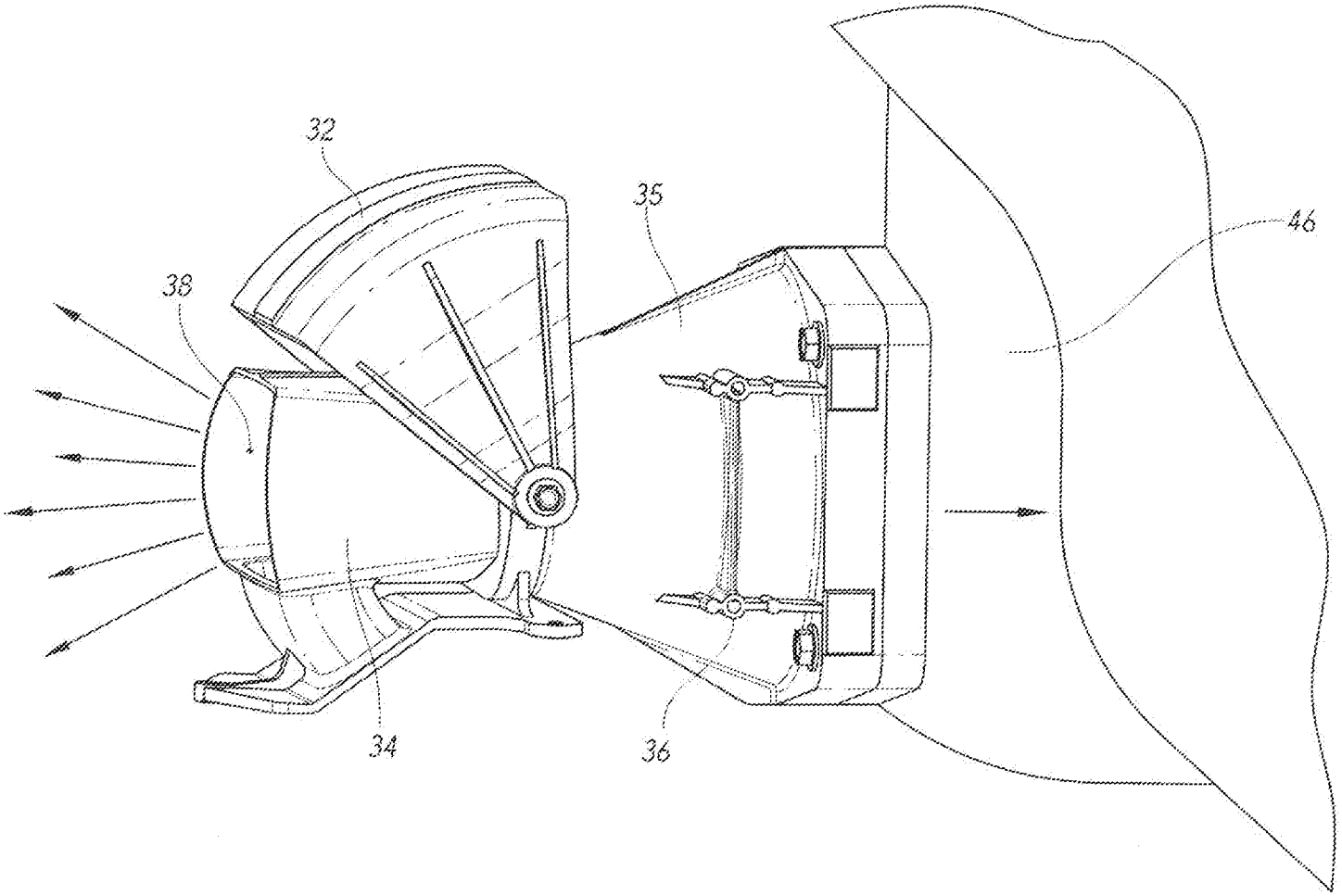
FIG. 4 (PRIOR ART)
FIG. 4 is a perspective view, showing a prior art deflector nozzle.
Figure 5:
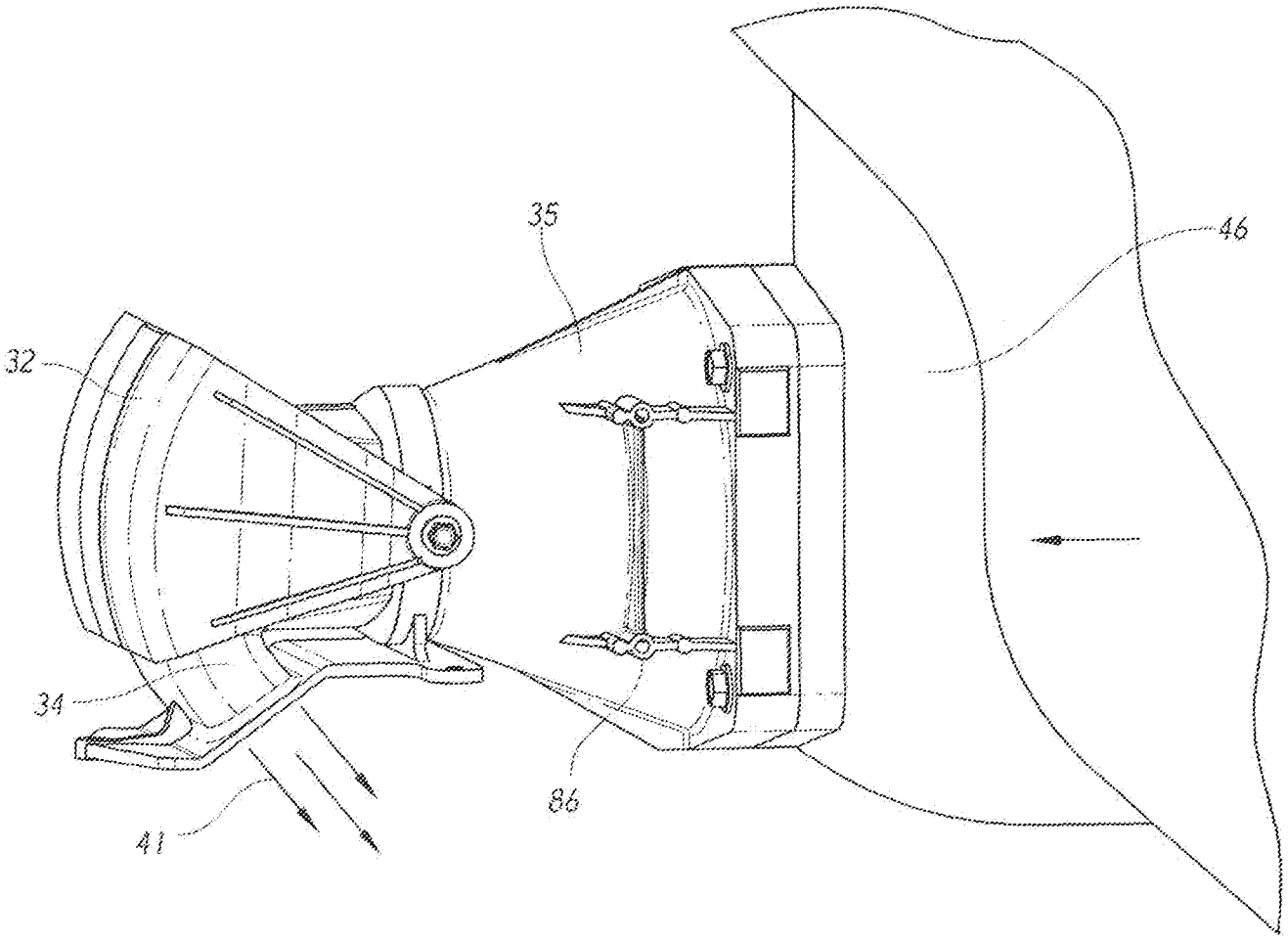
FIG. 5 (PRIOR ART)
FIG. 5 is a perspective view, showing a prior art deflector nozzle in reverse.

10 device
12 main body
14 channel
16 inlet
18 outlet
20 attachment member
22 attachment point
24 bearing
26 impeller duct
27 impeller housing
28 pump assembly
30 watercraft
32 reverse gate
34 deflector nozzle
35 nozzle
36 steering wheel
38 first nozzle outlet
40 jet stream
41 reverse flow
42 sidewall
44 fastener hole
46 hull
48 first surface
50 outer wall
52 centerline
54 first end
56 second end
58 inlet cross section point
60 outlet cross section point
62 first radius
64 second radius
66 center of curvature
68 degree of curve
70 inlet center point
72 outlet center point
74 fastener
76 molded voids
78 base connection
80 third radius
82 fourth radius
84 degree of centerline curve
86 molded raised portion
88 sidewall
90 center plane

DETAILED DESCRIPTION OF THE INVENTION

Figure 6:
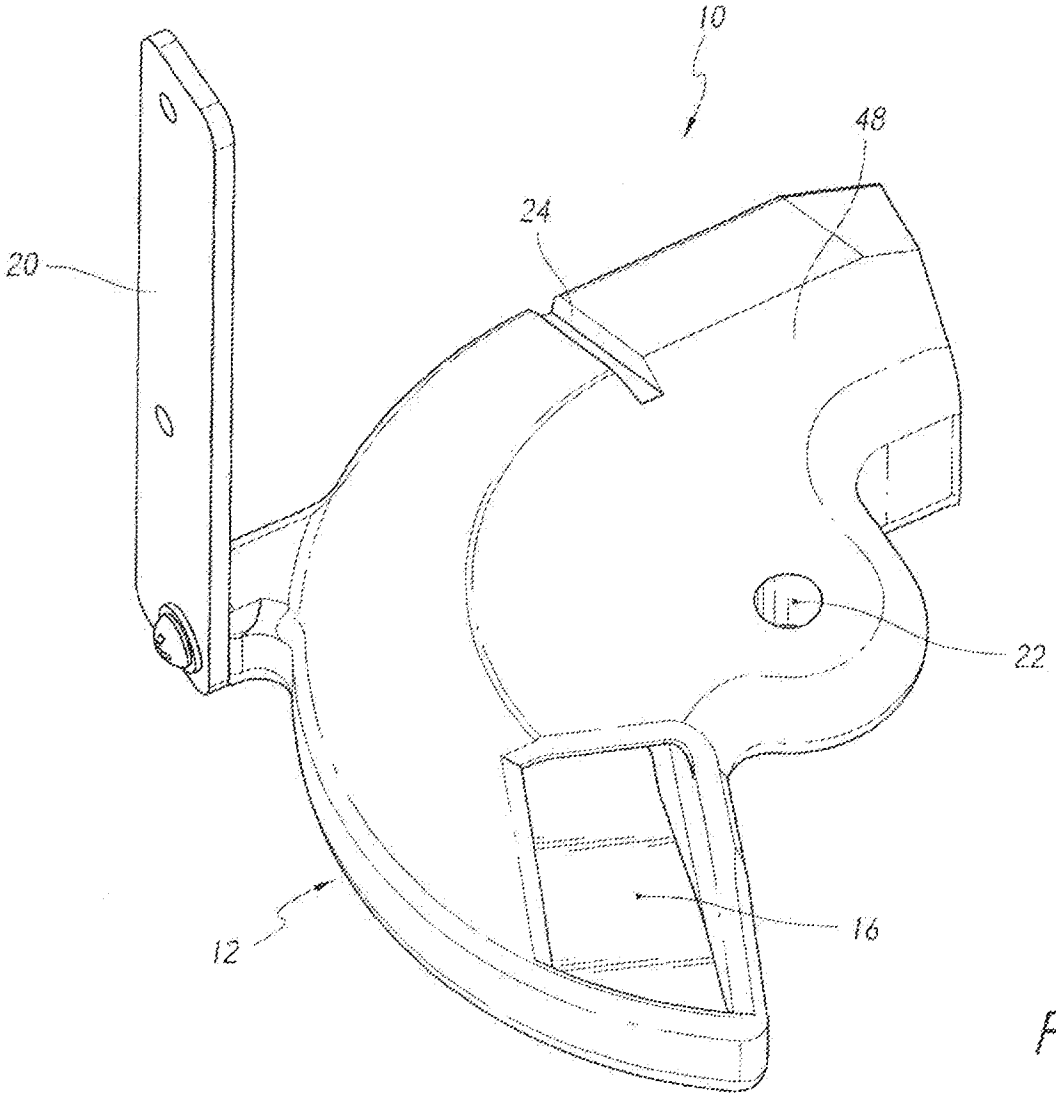
FIG. 6 is a perspective view, showing the present device.
Figure 7:
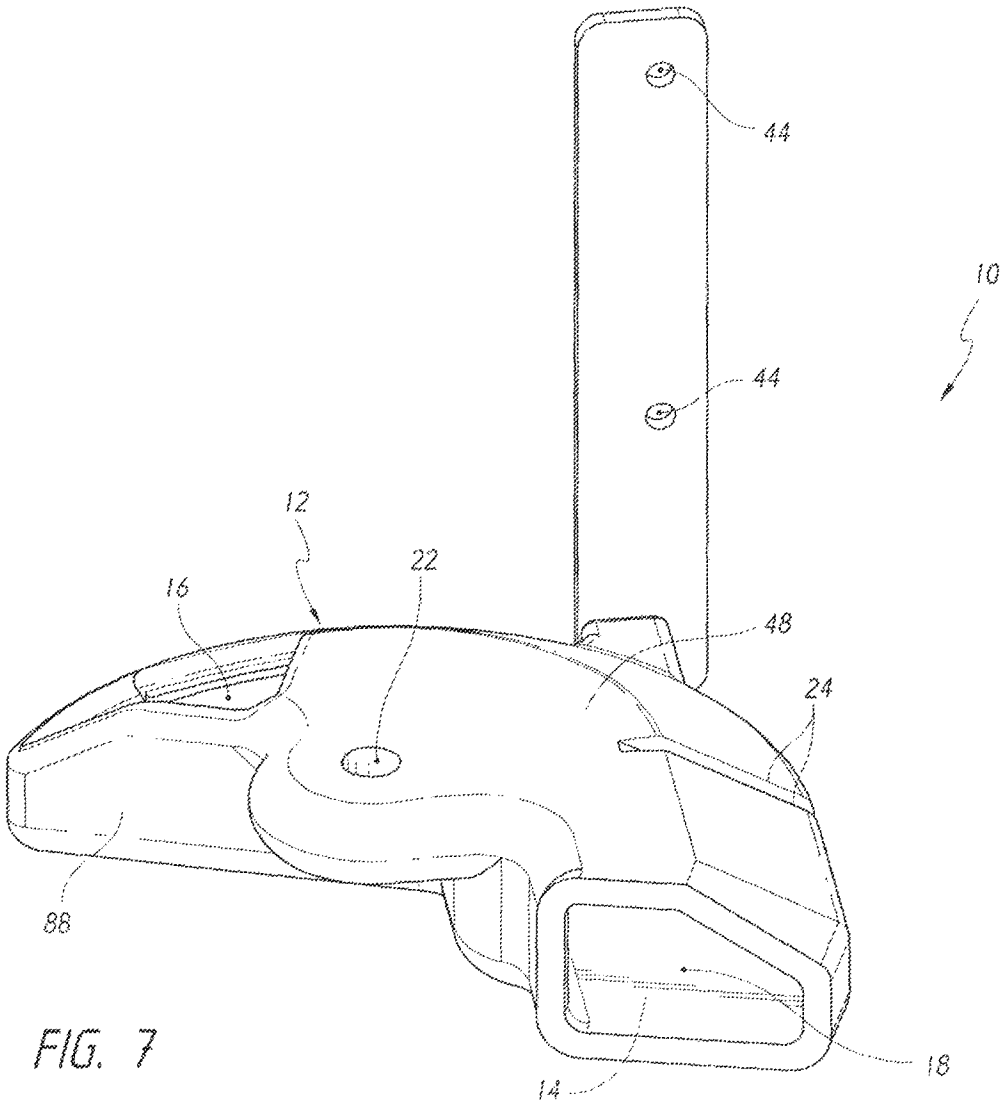
FIG. 7 is a perspective view, showing the present device.

FIG. 6-9 illustrate the present invention in the preferred embodiment. The device 10 redirects a portion of the reverse flow of a jet stream created by a watercraft. Main body 12 of device 10 has a channel 14 disposed therein. Channel 14 fluidly connects inlet 16 to outlet 18, as shown in FIG. 7. Device 10 is fixed to watercraft by bearing 24, attachment point 22 and attachment member 20, as further described herein. However, the reader will appreciate that any known method of fixing device 10 to watercraft can be used.

Figure 10:
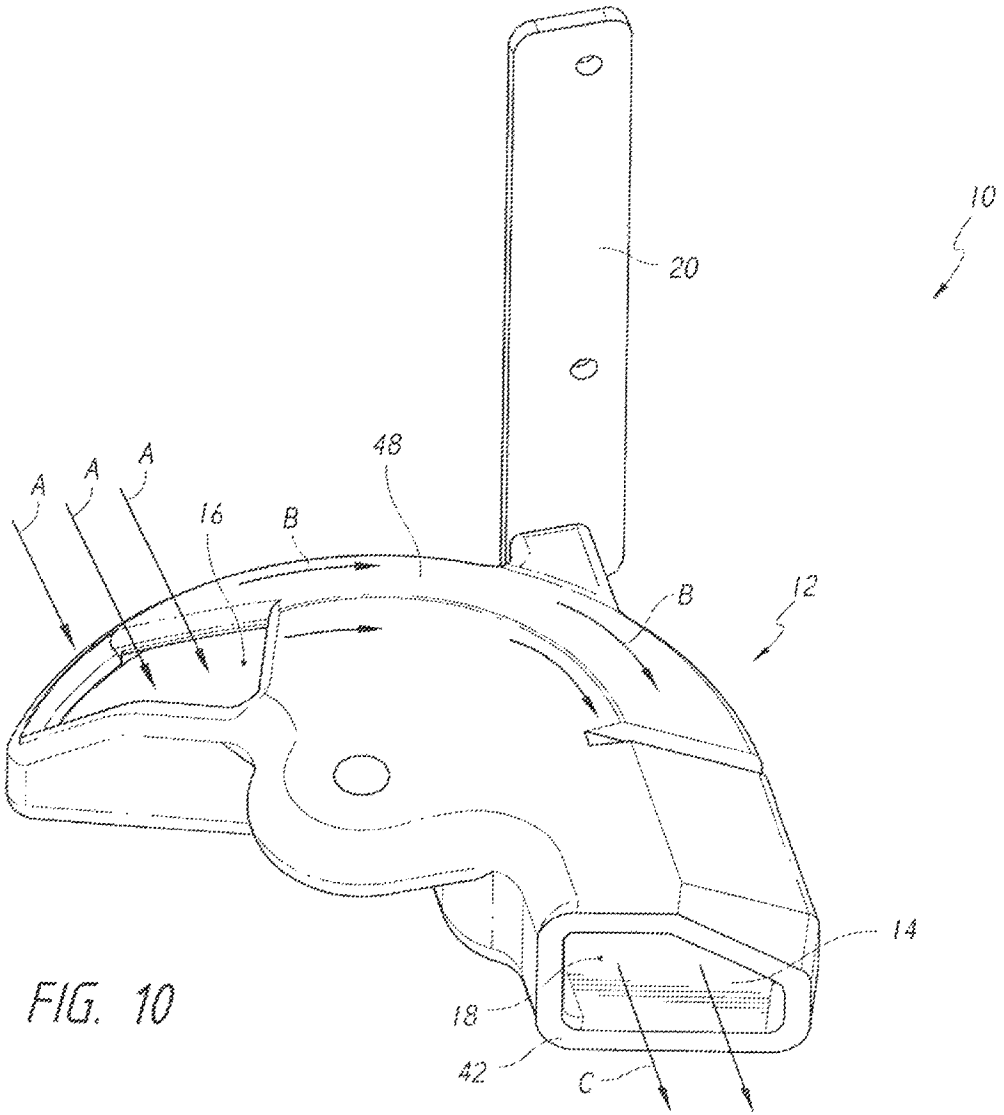
FIG. 10 is a perspective view, showing the reverse jet stream flow through the present device.

Inlet 16 is preferably located on the first surface 48 of main body 12. As illustrated in FIG. 10, the position of inlet 16 is such that jet stream reverse flow ("A") can enter channel 14 in a downward and backward direction with respect to main body 12. The entry of reverse flow through inlet 16 is shown by arrows labeled "A". As the reverse flow of jet stream enters inlet 16, channel 14 bends reverse flow and directs it towards outlet 18 (bending of reverse flow is shown as arrows labeled "B"). Outlet 18 is located on (or formed within) sidewall 42 of main body 12. As the reverse flow is expelled through outlet 18, the flow is primarily lateral (shown as arrows labeled "C"). The expulsion of lateral reverse flow through outlet 18 provides a lateral thrust to watercraft.

Figure 8:
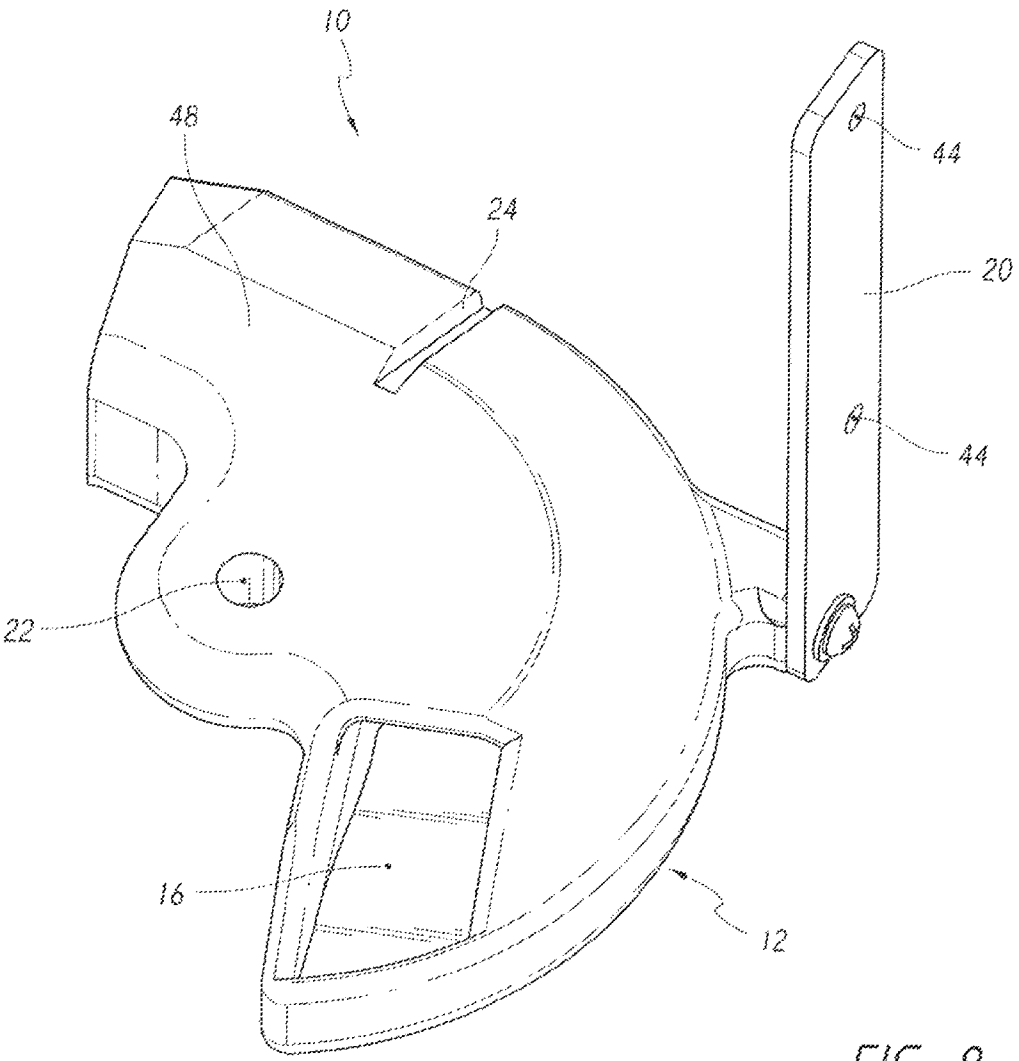
FIG. 8 is a perspective view, showing a mirror image of the present device.

On a twin-engine watercraft, device 10 is proximate each deflector nozzle 34. However, if an identical device is used, the lateral thrust would be entirely directed to one side of the watercraft. Therefore, a mirror image of device 10 is proximate second deflector nozzle 34 such that lateral thrust can be generated to either side of the watercraft. Mirror image of device 10 as illustrated in FIG. 6 is shown in FIG. 8.

Figure 9:
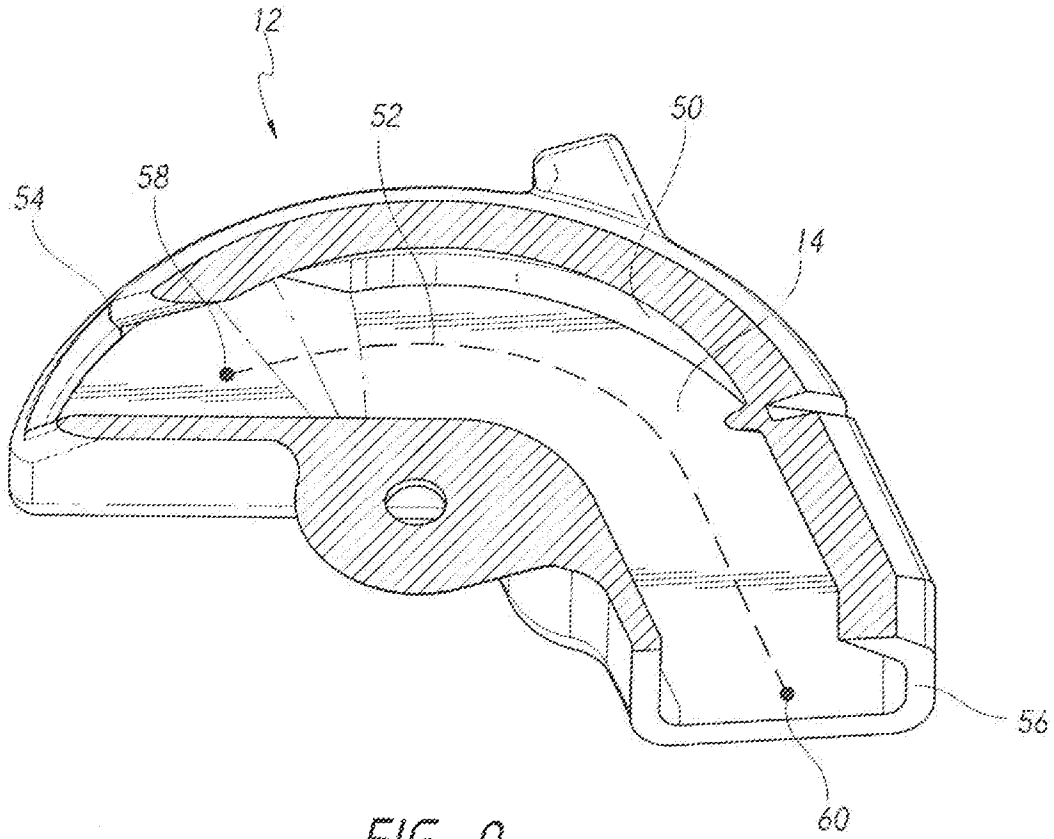
FIG. 9 is a cut-away view, showing a portion of the present device.

A cut away view of main body 12 (with top surface removed) is shown in FIG. 9. Channel 14 is defined on its outer edge by outer wall 50. Outer wall 50 has a first end 54, proximate inlet, and a second end 56, proximate outlet. Jet stream is redirected by channel 14 and primarily follows centerline 52 of channel 14.

Figure 11:
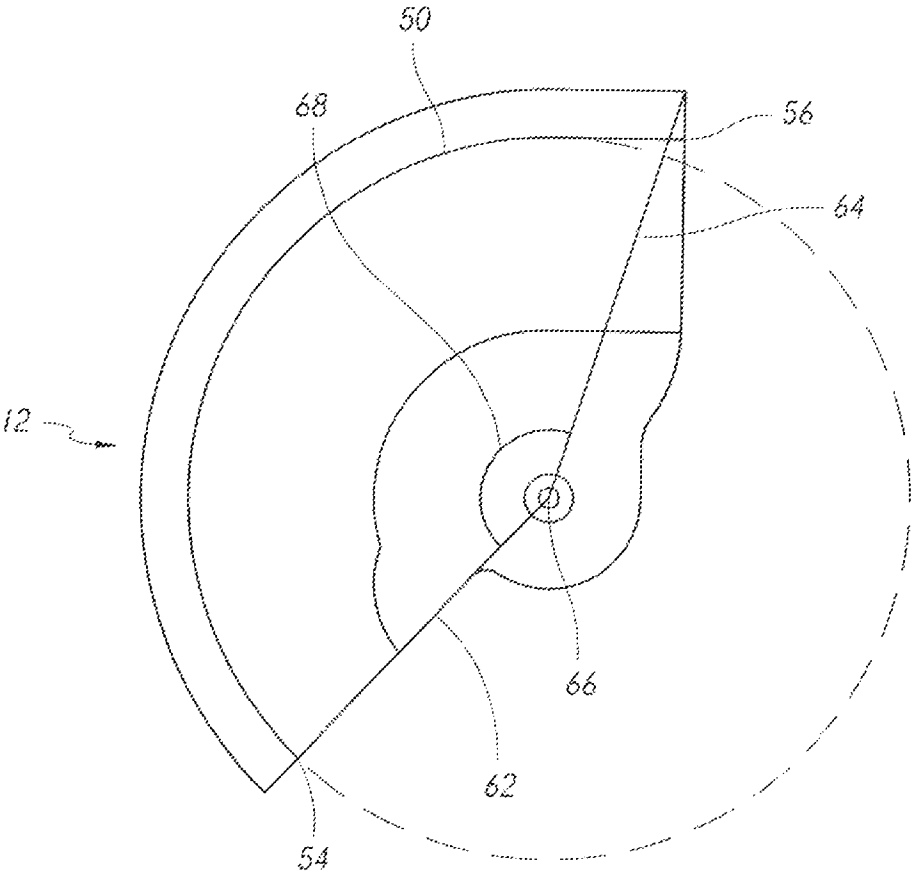
FIG. 11 is a schematic view, showing the geometry of the present device.

FIG. 11 is a schematic view of the geometry of the present device 10. Outer wall 50 has a curve from first end 54 to second end 56. The curve of outer wall 50 can be measured by determining the degree of the curve 68. The curve of outer wall 50 can be projected into a full circle, shown by broken lines. Center of curvature 66 falls in the middle of circle. The radius from the center of curvature to the first end 54 of outer wall 50 is defined as a first radius 62 and the radius from the center of curvature 66 to the second end 56 of outer wall 50 is defined as a second radius 64. The degree of outer wall curve is measured at the angle formed between the two radii. The degree of curve 68 of outer wall is greater than 90 degrees.

Figure 12:
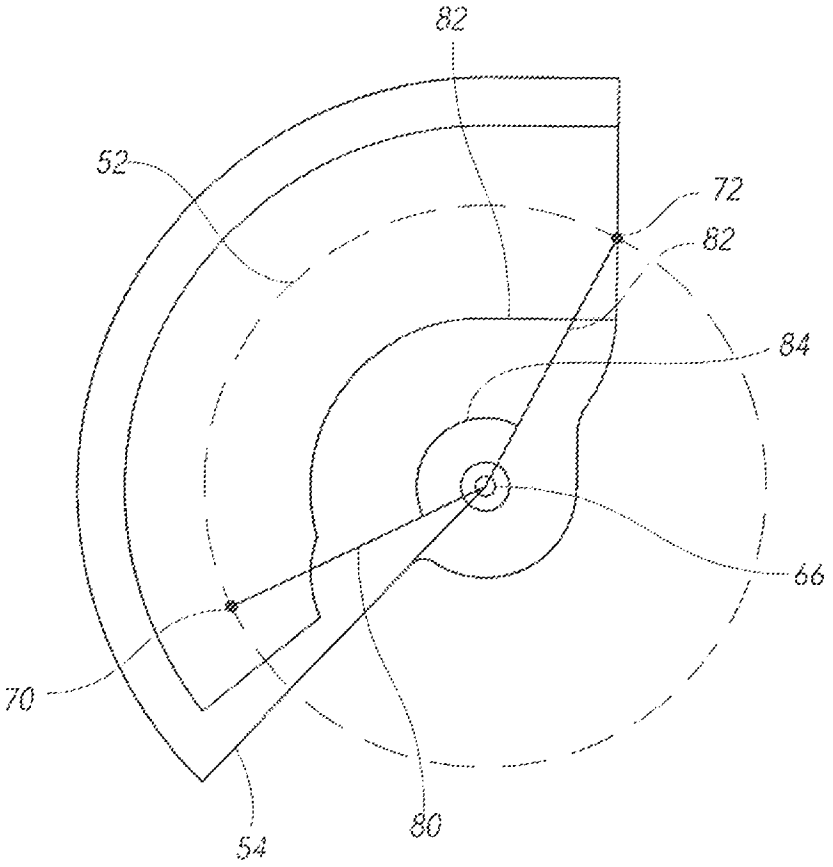
FIG. 12 is a schematic view, showing the geometry of the present device.

Similarly, the degree of curve 84 of centerline 52 can also be determined, as shown in FIG. 12. Inlet has a cross section with a center-point 70 and outlet has a cross section with a center-point 72. Centerline 52 is projected into a full circle (shown in broken lines). The center of curvature 66 (or center of circle) falls in the middle of the projected circle. The radius from the center of curvature 66 to the inlet center-point 70 is defined as third radius 80. The radius from the center of curvature 66 to the outlet center-point 72 is defined as fourth radius 82. The degree of centerline curve 84 is greater than 90 degrees.

Figure 13:
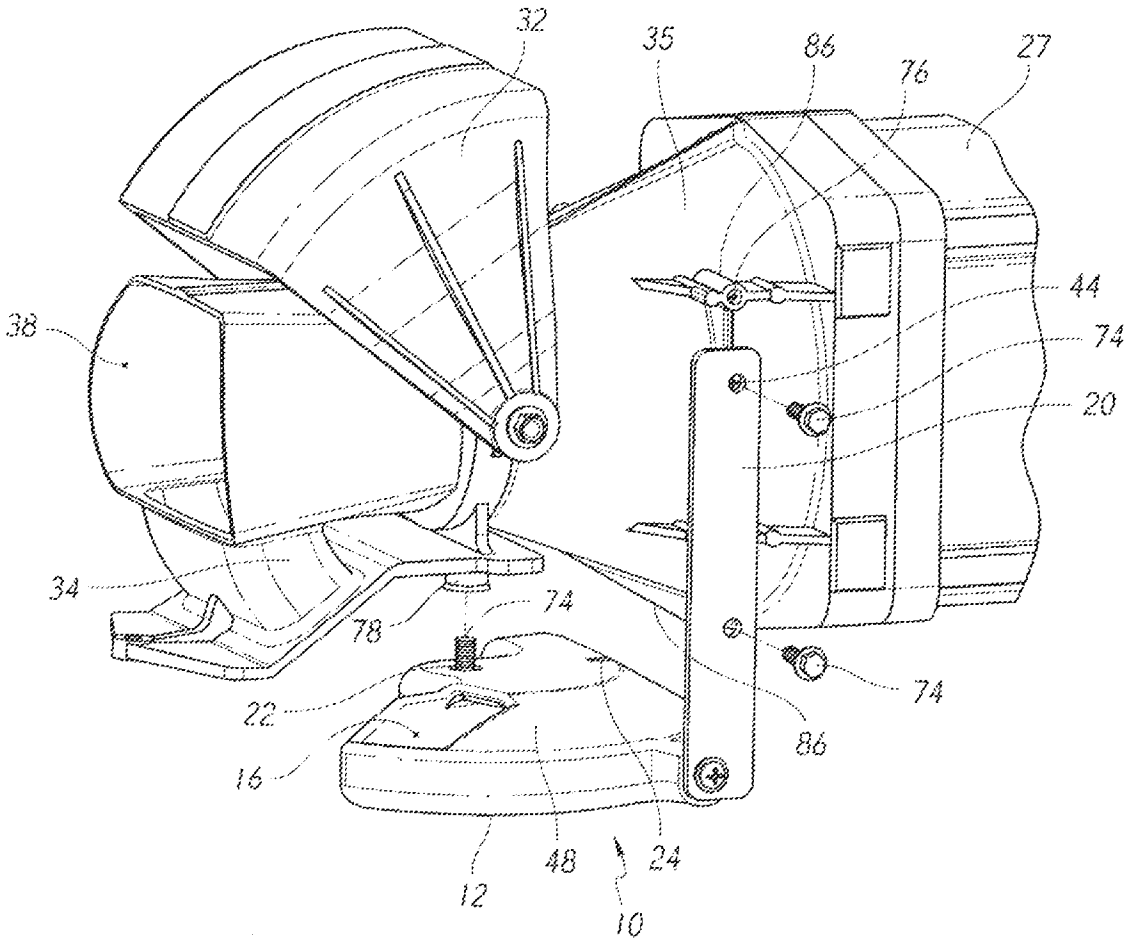
FIG. 13 is a perspective view, showing the present device aligned with prior art jet propulsion system.
Figure 14:
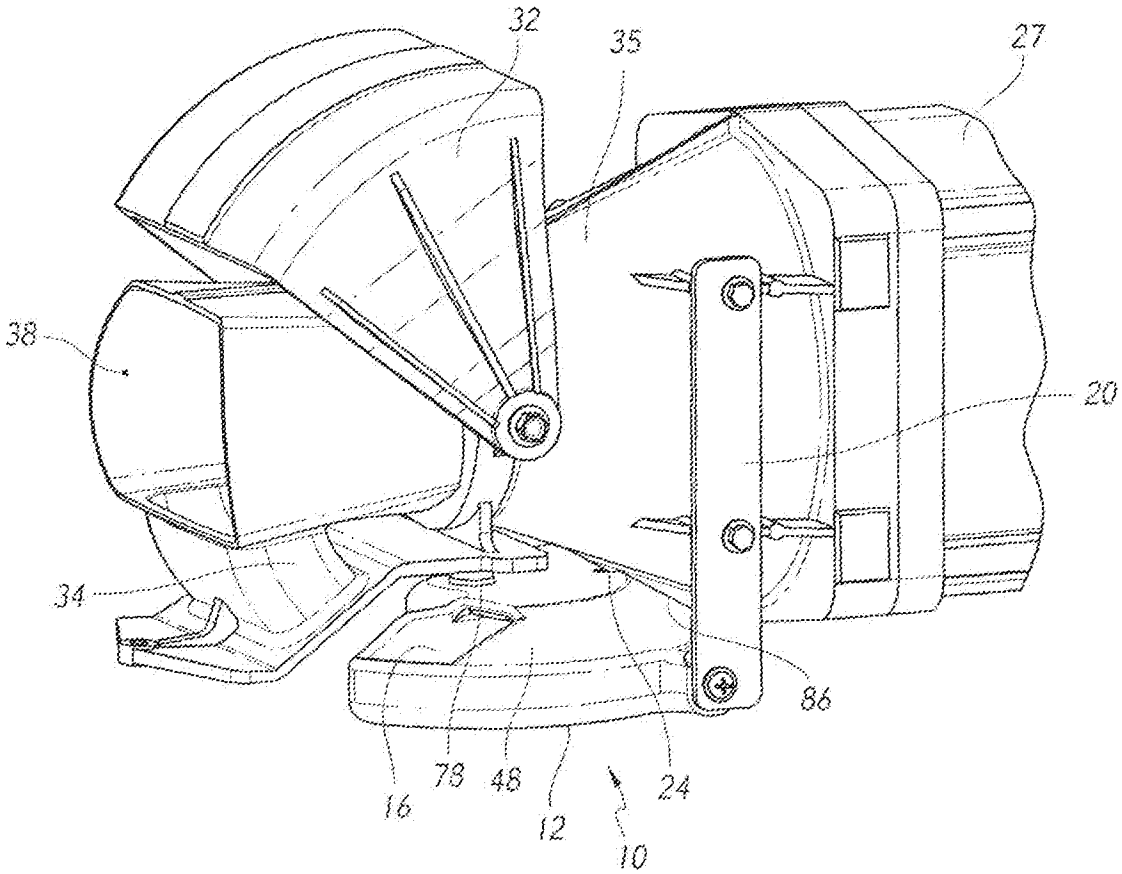
FIG. 14 is a perspective view, showing the present device attached to a prior art jet propulsion system.

FIGS. 13 and 14 are perspective views showing the present device 10 being attached to deflector nozzle 34 and pump 28. Main body 12 includes bearing 24 and attachment point 22. Attachment member 20 is fixed to main body 12 (or could be fully integrated with main body 12). Bearing 24 includes a notch and two elevated walls. Bearing 24 surrounds either side of molded raised portion 86 on the underside of pump 28. Molded raised portion 86 fits into notch and rests against bearing 24. Bearing 24 prevents device 10 from shifting left and right and assists in installation of device 10 by maintaining the device 10 square to the pump 28 during attachment. Attachment member 20 extends upward from main body 12 and aligns with molded voids that accept fasteners (bolt or screw). Attachment point 22 aligns with base connection 78. Fastener 74 is threaded through attachment point 22 and into base connection 78. Device 10 is fixed in place beneath deflector nozzle 34 and does not rotate.

Although the device 10 is shown attached to deflector nozzle 34 and pump 28, the reader will appreciate that the present device 10 could be fixed to watercraft at any place and in any known manner. In the alternative, device 10 could be fully integrated with a directional nozzle, fixed mounted nozzle, impeller duct, impeller housing, the hull, ride plate or any other part of watercraft. The important aspect of the attachment of device 10 to watercraft is that inlet 16 is fixed to watercraft such that inlet 16 accepts a portion of jet stream from deflector nozzle 34, when deflector nozzle 34 is in a specific rotational position, as further described below.

Figure 15:
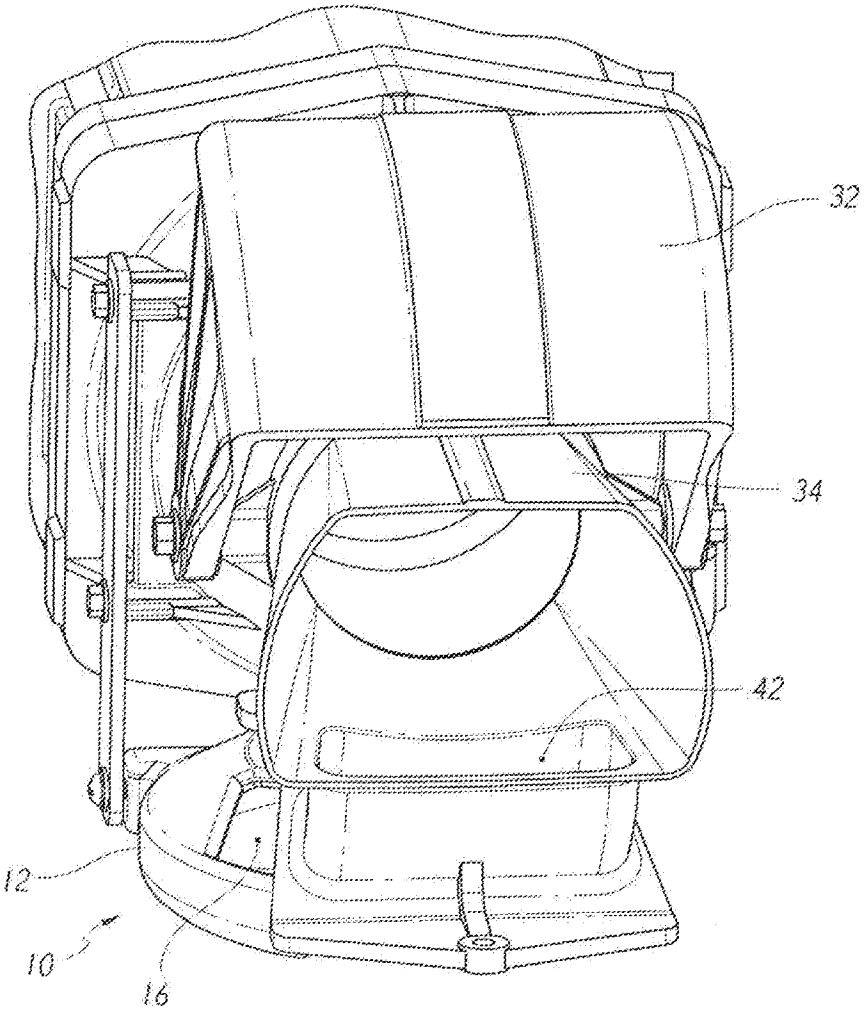
FIG. 15 is a perspective view, showing the present device attached to prior art jet propulsion system and aligned with prior art nozzle.
Figure 16:
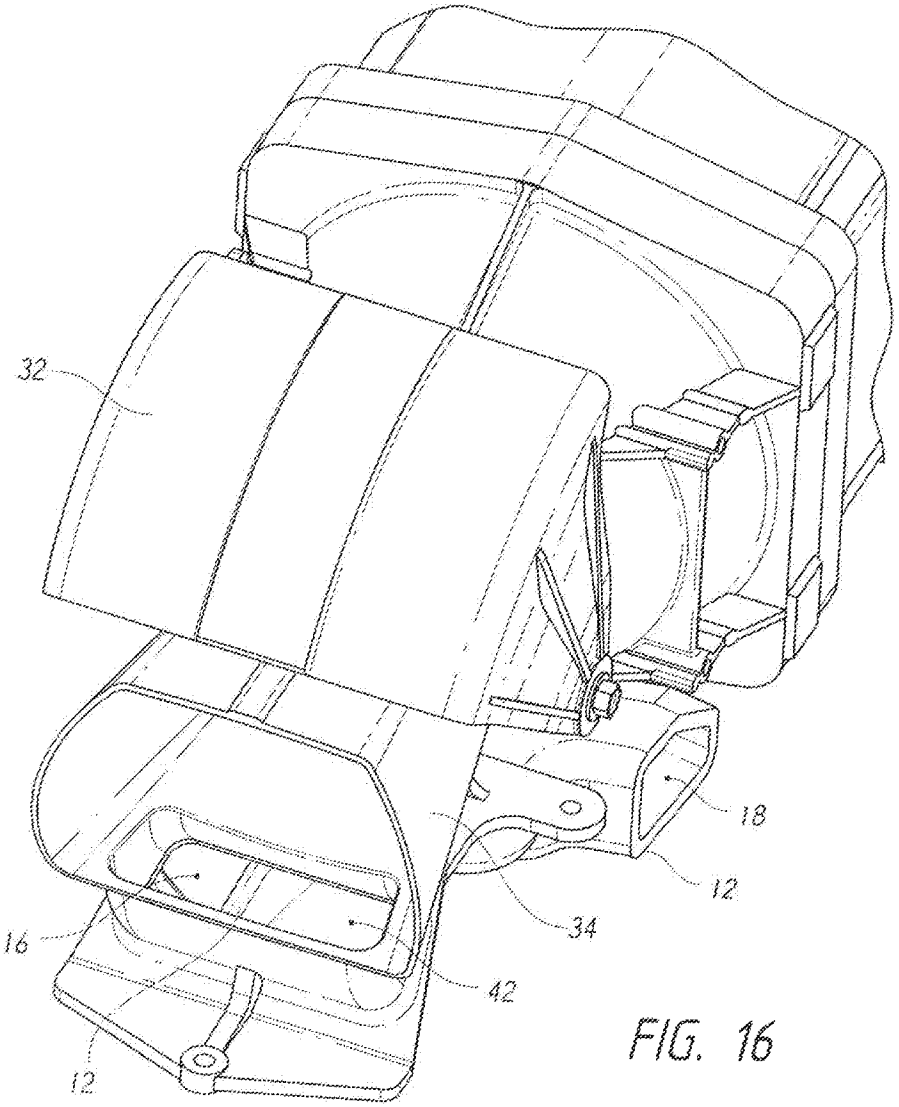
FIG. 16 is a perspective view, showing the present device attached to prior art jet propulsion system and aligned with prior art nozzle.

FIGS. 15 and 16 show device 10 in position beneath deflector nozzle 34. For purpose of illustration, reverse gate 32 is shown in a raised position. However, reverse gate 32 would be lowered into the closed position to activate the reverse jet stream flow (and the present device 10). When deflector nozzle 34 is square to the watercraft (dead center), the reverse flow is not redirected by device 10. As shown in FIG. 15, no portion of inlet 16 on main body 12 of device 10 is aligned with reverse nozzle outlet 42. Thus, when nozzle is dead center, reverse flow is not redirected causing unwanted lateral thrust. However, as shown in FIG. 16, when deflector nozzle 34 is fully rotated toward inlet 16, inlet 16 becomes aligned with one side of reverse nozzle outlet 42. Inlet 16 spans approximately, but not limited to, one-third of reverse nozzle outlet 42. Thus, inlet 16 redirects approximately, but not limited to, one-third of reverse jet stream when in operation. The lateral thrust provides more control over steering while operating the watercraft in reverse. It is important to note that as deflector nozzle 34 rotates, the area of inlet 16 accepting reverse flow increases. Thus, lateral thrust slowly increases proportionately to the amount of water being forced into inlet 16. When in operation, the driver enjoys a precise level of control while in reverse. By varying the degree of rotation of the steering wheel the lateral thrust provided can be increased or decreased, thereby providing exceptional control input and confidence for the driver.

Figure 17C:
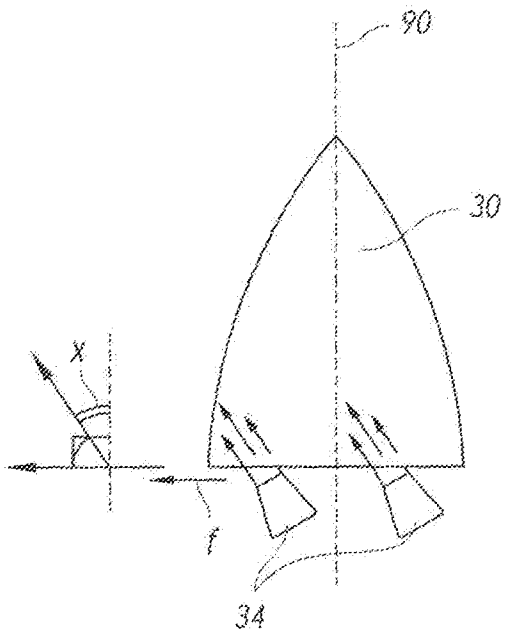
FIGS. 17B and 17C are schematic views, showing simplified depictions of reverse flow on a watercraft with present device attached thereto.
Figure 17B:
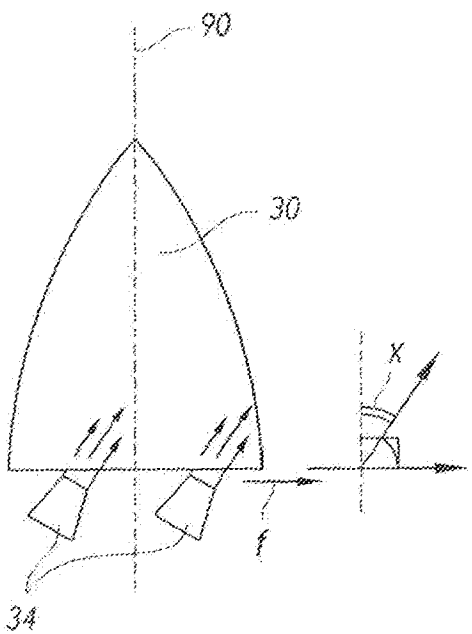
Figure 17A:
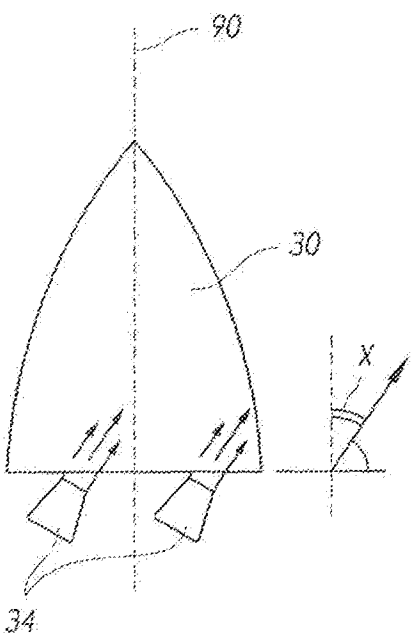
FIG. 17A (PRIOR ART)
FIG. 17A is a schematic view, showing a simplified depiction of reverse flow on a watercraft.

FIGS. 17A, B and C show schematic views of jet stream redirection while in reverse. FIG. 17A is a schematic view of a prior art system with twin engines. Each deflector nozzle 34 in FIG. 17A is rotated toward the port side of the watercraft 30. When the reverse gate (shown in FIG. 1) is in a closed position, the jet stream (shown with arrows) is angularly displaced from the center plane of watercraft 90 by approximately 30 degrees (shown as angle x to the side of depiction of watercraft). FIG. 17B illustrates the jet stream redirection while in reverse with the present device employed. Again, each deflector nozzle 34 is rotated toward the port side of watercraft 30. However, the starboard deflector nozzle 34 is now aligned with inlet of device (such as shown in FIG. 16). A portion of the reverse flow is accepted into inlet and redirected through channel and expelled through outlet. The letter f represents the redirected reverse flow exiting outlet on starboard deflector nozzle 34. As illustrated, approximately one-third of the reverse flow from the starboard deflector nozzle 34 is redirected laterally. Thus, only one-sixth of the total reverse flow from both deflector nozzles 34 is redirected laterally through device. The reader will appreciate that the amount of reverse flow that is redirected can be larger or smaller and should be set by the claims herein. The redirection provides an efficient and functional lateral thrust capable of acting on the watercraft while in reverse. The redirected reverse flow "f" is angularly displaced from the center plane of watercraft 90 by approximately 90 degrees. The reader will appreciate that the angular displacement does not have to be exactly 90 degrees. Instead the angular displacement could be adjustable and/or greater than 45 degrees from center plane 90 of watercraft. In a preferred embodiment, the angular displacement of the redirected reverse flow "f" is 90 degrees or greater.

FIG. 17C illustrates the jet stream redirection while in reverse, with both deflector nozzles 34 rotated toward the starboard side of watercraft 30. The port deflector nozzle 34 is now aligned with inlet of device (mirror image of FIG. 16). Again, the redirected reverse flow provides lateral thrust and is illustrated by the letter f in FIG. 17C. The redirected reverse flow is angularly displaced from the center plane of watercraft 90 by approximately 90 degrees or greater. Again, only one-sixth of the total reverse flow from both deflector nozzles 34 is redirected laterally through the device in the illustrated position.

Figure 18:
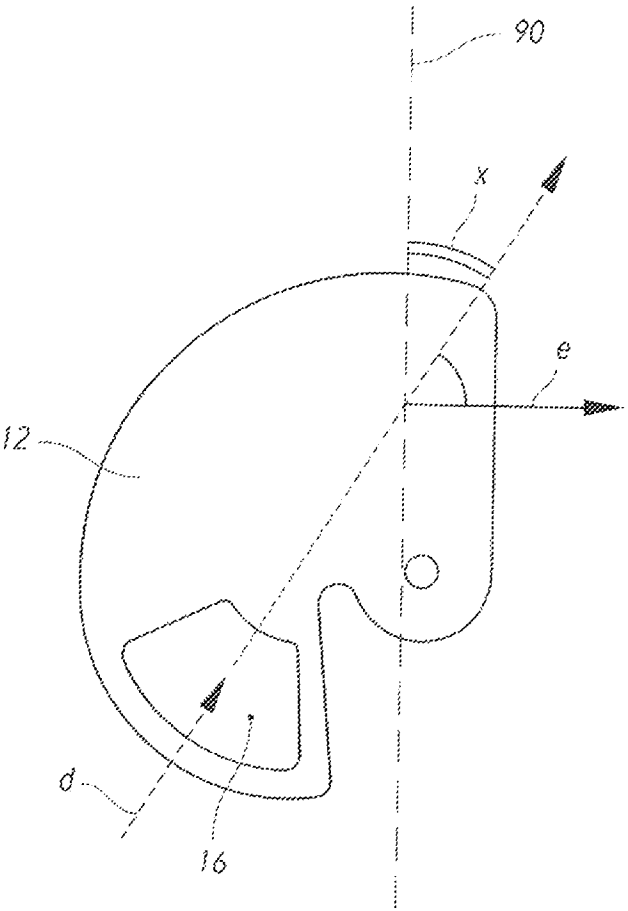
FIG. 18 is a schematic view, showing the angular displacement of reverse flow with respect to the present device and center plane of watercraft.

FIG. 18 provides further illustration of the angular displacement of the reverse flow with respect to the center plane of watercraft 90. As water enters inlet 16, it is traveling in a downward and backward direction (shown as letter 'd') at approximately 30-degree displacement from center plane of watercraft 90 (angle of displacement shown as letter 'x'). Channel (not shown) within main body 12 redirects the reverse flow laterally. Reverse flow exits outlet at approximately 90-degree displacement from center plane of watercraft 90 (lateral flow shown as arrow 'e').

The preceding description contains significant detail regarding the novel aspects of the present invention. It should not be construed, however, as limiting the scope of the invention but rather as providing illustrations of the preferred embodiments of the invention. As an example, device 10 can be fixed to underside of watercraft at jet propulsion system (pump) deflector nozzle, nozzle, impeller duct, impeller housing or device 10 can be fully integrated with watercraft ride plate (not shown) or hull. Device 10 can be any shape such that redirection of reverse flow occurs as is described (e.g. outer wall does not have to be a discreet curve). Additionally, the reverse flow can be angularly displaced from the center plane of watercraft by greater than 45 degrees. Thus, the scope of the invention should be fixed by the following claims, rather than by the examples given.

Having described my invention, I claim:

1. A device for redirecting a portion of the reverse flow of a jet stream created by a watercraft having a center plane, having a pump assembly, wherein said pump assembly has an impeller duct, an impeller housing, a nozzle and a deflector nozzle having a reverse gate pivotably connected to said nozzle, said device comprising:

a main body, fixed to said watercraft, having a channel disposed therein;

wherein said channel has an outer wall, an inlet and an outlet;

wherein said channel is configured to redirect said portion of said reverse flow of said jet stream when said deflector nozzle is in position over said inlet;

wherein said portion of said reverse flow into said inlet is in a downward and backward direction with respect to said main body;

wherein said inlet and said channel bend said reverse flow such that when said reverse flow exits said outlet said reverse flow is primarily a lateral flow;

wherein said outer wall of said channel has a curve having a first end and a second end; and wherein said curve of said outer wall has a degree of curve from said first end to said second end that is greater than 90 degrees.

2. A device for redirecting a portion of the reverse flow of a jet stream created by a watercraft having a center plane, having a pump assembly, wherein said pump assembly has an impeller duet, an impeller housing, a nozzle and a deflector nozzle having a reverse gate pivotably connected to said nozzle, said device comprising:

a main body, fixed to said watercraft, having a channel disposed therein;

wherein said channel has an outer wall, an inlet and an outlet;

wherein said channel is configured to redirect said portion of said reverse flow of said jet stream when said deflector nozzle is in position over said inlet;

wherein said portion of said reverse flow into said inlet is in a downward and backward direction with respect to said main body;

wherein said inlet and said channel bend said reverse flow such that when said reverse flow exits said outlet said reverse flow is primarily a lateral flow; and wherein said reverse flow is angularly displaced from said center plane of said watercraft by greater than 45 degrees.

3. The device as recited in claim 2, wherein said reverse flow is angularly displaced from said center plane of said watercraft by greater than or equal to 90 degrees.

4. The device as recited in claim 2, wherein said inlet has an area and is fixed in place beneath said deflector nozzle; wherein as said deflector nozzle pivots toward one side of said watercraft over said inlet, said area of inlet configured to accept said reverse flow increases.

5. The device as recited in claim 4, wherein said portion of said reverse flow redirected is a maximum of one-third of said reverse flow expelled from said deflector nozzle.

6. A device for redirecting a portion of the reverse flow of a jet stream created by a watercraft, having a pump assembly, wherein said pump assembly has an impeller duct, an impeller housing, a nozzle and a deflector nozzle having a reverse gate pivotably connected to said nozzle, said device comprising:

a main body, fixed to said watercraft, having an inlet, an outlet and a channel disposed therein;

wherein said channel fluidly connects said inlet to said outlet;

wherein said inlet has an inlet cross section point and said outlet has an outlet cross section point;

wherein said channel has an outer wall, an inner wall and a centerline;

wherein said centerline of said channel intersects with said inlet cross section point and said outlet cross section point; and wherein said centerline has a degree of curve from said inlet cross section to said outlet cross section of greater than 90 degrees.

7. The device as recited in claim 6, further comprising:

an attachment member affixed to main body; and wherein said attachment member connects said device to said nozzle.

8. The device as recited in claim 6, wherein said main body has an attachment point configured to attach beneath said deflector nozzle.

9. The device as recited in claim 8, wherein said main body has a bearing including a notch and two elevated walls.

10. The device as recited in claim 6, wherein said inlet has an area and is fixed in place beneath said deflector nozzle; wherein as said deflector nozzle pivots toward one side of said watercraft over said inlet, said area of inlet configured to accept said reverse flow increases.

11. The device as recited in claim 10, wherein said portion of said reverse flow redirected is a maximum of one-third of said reverse flow expelled from said deflector nozzle.

12. A device for redirecting a portion of the reverse flow of a jet stream created by a watercraft having a first and a second engine, wherein said first and second engine each have a pump assembly, wherein said pump assembly has an impeller duct, an impeller housing, a nozzle and a first and second deflector nozzle having a reverse gate pivotably connected to said nozzle, said device comprising:

a first main body, fixed to said watercraft proximate said first deflector nozzle of said first engine, having an inlet, an outlet and a channel disposed therein;

a second main body, fixed to said watercraft proximate said second deflector nozzle of said second engine, having an inlet, an outlet and a channel disposed therein;

wherein said channel on said first and second main body fluidly connects said inlet to said outlet;

wherein said inlet of said first and second main body have an inlet cross section point and said outlet has an outlet cross section point;

wherein said channel of said first and second main body have an outer wall, an inner wall and a centerline;

wherein said centerline of said channel intersects with said inlet cross section point and said outlet cross section point;

wherein said centerline has a degree of curve from said inlet cross section to said outlet cross section of greater than 90 degrees; and wherein said first main body is a mirror image of said second main body.

13. The device as recited in claim 12, further comprising:

an attachment member affixed to said first and second main body;

wherein said attachment member connects said device to said nozzle; and wherein said first main body and second main body have an attachment point configured to attach beneath said first and second deflector nozzle respectively.

14. The device as recited in claim 13, wherein said first and second main body have a bearing including a notch and two elevated walls.

15. The device as recited in claim 12, wherein said inlet each have an area; wherein said inlet of said first main body and said inlet of said second main body are fixed in place beneath said first and second deflector nozzle respectively such that as said first deflector pivots towards the starboard side of said watercraft, said area of inlet of said first main body configured to accept said reverse flow increases and as said second deflector nozzles pivots toward the port side of said watercraft, said area of said inlet of said second main body configured to accept said reverse flow increases.

16. The device as recited in claim 15, wherein said portion of said reverse flow redirected is a maximum of one-sixth of said reverse flow expelled from said first deflector nozzle and second deflector nozzle.

* * * * *